United States Patent [19]

Visnapuu et al.

[11] 4,079,809

[45] Mar. 21, 1978

[54] MUFFLER FOR PNEUMATIC DRILL

[75] Inventors: Aarne Visnapuu, Vida; Scott Emory Lay, Rolla, both of Mo.

[73] Assignee: The United States of America as represented by the Secretary of the Interior, Washington, D.C.

[21] Appl. No.: 815,127

[22] Filed: Jul. 13, 1977

[51] Int. Cl.[2] ..... F01N 1/08

[52] U.S. Cl. ..... 181/230; 181/272

[58] Field of Search ..... 181/211, 230, 271, 272, 181/277; 55/276; 173/DIG. 2; 415/119

[56] References Cited

U.S. PATENT DOCUMENTS

| | | | |
|---|---|---|---|
| 3,187,837 | 6/1965 | Beeching | 181/272 |
| 4,011,922 | 3/1977 | Goplen | 181/272 |

*Primary Examiner*—Robert C. Watson
*Attorney, Agent, or Firm*—Thomas Zack; Donald A. Gardiner

[57] ABSTRACT

A muffler for a percussive drill is provided consisting of a casing of general prismatic shape adapted for mounting on the drill. An inlet is present in the casing for receiving exhaust from the drill, the drill exhaust port and muffler inlet having the same cross-sectional area. Resilient rectangular baffles are mounted within the casing and are rigidly fastened at two opposite edges to the casing wall. The two other edges, which are longer than the fastened edges, are in contact with casing walls. Staggered holes are present in the baffles, so the gas flow through the muffler follows a sinusoidal path. The sides of the casing tapers down after the last baffle to a fraction of its height and then extend for a given length at the lessened height to form a narrow rectangular exhaust port. One face of the casing adjacent the exhaust port consists of resilient sheet material. The flow of gas through the muffler causes strong vibration of the baffles and resilient face near the exhaust port. As a result, ice which may be formed within the muffler, cannot accumulate on the surfaces and any ice formed is expelled through the exhaust port.

6 Claims, 4 Drawing Figures

MUFFLER FOR PNEUMATIC DRILL

BACKGROUND OF THE INVENTION

This invention relates to mufflers for the exhaust of pneumatic tools in general and more particularly for mechanized, jumbo mounted, percussive rock drills employed in the mining industry. It is recognized that such drills produce one of the most critical noise problems throughout the world in the field of mining. Expulsion of compressed air from air drills creates a high noise level which must be lowered to enable the operator of the drill to work in comfort and safety.

Attempts to reduce air-exhaust noises in pneumatic percussion rock drills have been directed primarily to hand held and feed leg drills. Retrofit mufflers with chambers around the drill body and exhaust port, have been devised. Such prior art mufflers are illustrated for example, in U.S. Pat. Nos. 3,255,884 and 3,554,316; and British Pat. No. 329,239. However, in many cases, mufflers of this general class have added excess weight, have not been able to withstand rough handling and have suffered from ice accumulation.

Attempts to retrofit mufflers on mechanized jumbo mounted pneumatic drills have been beset by similar problems. Although the added weight can generally be disregarded, bulk, protruding parts and icing are serious problems and have limited retrofit mufflers on jumbo drills. Since the drills often operate in close quarters any protruding portions or air lines are susceptible to being torn off by accidental contact with rocky walls. In addition the large volume of air passing through greatly increase the icing problem.

Conventional jumbo mounted percussive rock drills operate by compressed air which impells a piston in a cylinder to strike a striker-bar. A drill steel rod, attached to the striker-bar, has a drill bit at the other end which digs into the rock. Means are provided for reciprocating the piston within the cylinder and for rotating the drill bit.

In a mechanized mining operation, the drill is mounted on a carriage plate which rides on a boom that can be orinted in a number of directions. One or more booms may be attached to a jumbo or crawler drilling rig. A chain drive attached to the carriage plate provides for advancement and retraction of the drill and for maintaining constant pressure on the drill bit.

During operation of the drill, the compressed-air driven reciprocating piston moves back and forth about 20 to 60 times per second and compressed air is released to the atmosphere twice for each complete piston cycle. The release of compressed air at high velocity into the relatively calm atmosphere generates excessive noise which corresponds to the release frequency and its hormonics, up to the 15th harmonic. Mixing of the high velocity air with the relatively calm atmospheric air produces intense, broadband noise in the frequency range of 2000 to 12,000 Hz. Adiabatic expansion of the air upon release cools it to temperature as low as −40° C, causing the moisture in the air to crystallize out as ice.

BRIEF DESCRIPTION OF THE INVENTION

The present invention comprises a compact retrofit reactive muffler which reduces the noise generated by the escaping air by means of internal reflections, elimination of a direct acoustical path, and the reduction of air exhaust velocity. Ice accumulation is eliminated by the use of flexible baffles made of neoprene or the like in the muffler interior with alternate edge and center air passage holes. The baffles are generally perpendicular to the direction of airflow, are rigidly fastened at two opposite sides to the muffler, and are free to vibrate while contacting the other muffler walls so that ice will not accumulate. A short restricted air passage leads from the muffler inlet to the muffler chamber, the air passage being dimensioned to avoid adiabatic expansion of the air before reaching the baffles. The height of the muffler sides are tapered down after the last baffle and the shortened height sides extended to form an exit port. At least one of the longer muffler sides at the end portion is of flexible sheet material, similar to the baffles.

The muffler of the present invention is basically of the reactive type for which a lengthy outlet of reduced cross-section area in relation to the muffler body is an essential element. While the most logical outlet shape is a round tube, this is not practical here since the abrupt changes in muffler dimensions required for joining a tube to a prism would cause icing problem and the inner openings of the tube would become blocked. By tapering the muffler as described, a narrow rectangular outlet pipe with the same accoustical characteristics as a length of round tubing is obtained.

The advantages of the compact, reactive muffler for the mounted percussive drills of this invention include:

1. Due to its compact size it can be adapted to mount in confined space where it does not interfere with normal drill operation or prone to be torn off.
2. It is resistant to ice accumulation and therefore will not slow or completely stop the drill because of ice blockage of the exhaust-air path.
3. It is easy to manufacture, install, maintain, and service.
4. Does not adversely affect the drilling rate.
5. Can be readily adapted to fit drill exteriors.
6. Rugged construction allows the muffler to withstand abusive treatment in the mine.
7. Reduces the exhaust noise to a level below the drill steel and machine noise.

The main object of this invention, therefore, is to provide a muffler device which is of simple construction and relatively inexpensive to manufacture and is adapted to be attached to a percussive pneumatic rock drill.

It is another object of this invention to provide a muffler with a casing of a general polygonal cross-section, such as rectangular, having resilient baffles therein rigidly fastened to opposite side walls of the casing, said baffles having staggered opening therein for gas passage.

A further object is to provide a muffler having its entry port passageway within the casing curved 90° whereby the casing may be mounted on the body of the percussive rock drill.

A further object of the invention is to provide an exit port for the muffler in the shape of a narrow rectangular opening having the same width as the muffler with the end portion of the casing tapered down and extended to the exit port.

Yet a further object of the invention is to provide a resilient portion in the casing adjacent the rectangular exit port at its wide portion.

Further objects will be apparent from the drawing and specification.

BRIEF DESCRIPTION OF THE DRAWING

Referring to FIG. 1, reference numeral 1 refers generally to a conventional penumatic rock drill mounted on carrier plates 7 by bolts 30. The cylinder of the drill is shown at 4 mounted on the drill by bolts 2 and plate 3. The compressed air exhaust port is shown at 5. The muffler, referred to generally as 6, is bolted on drill carriage plate 7.

As shown in FIGS. 2,3 and 4, muffler 6 consists of a top cover 8, and a body portion having sides 9, bottom plate 10, rear portion 11 and exit port 12. Cover 8 is fastened to the body portion of the muffler by bolts 13 passing through holes 14 in the cover 8 and lugs 15 mounted on sides 9. Although the muffler is shown as being rectangular in cross-section, and this shape would normally be the most desirable, other polygonal shapes may be employed where thought desirable, as for example, trapezoidal.

Muffler 6 is bolted to drill carriage plates 7 by bolts 16 which pass through hole 31 in bottom plate 10 (FIG. 2) and by compression of drill air exhaust port 5 on muffler inlet port 17 when drill 1 is bolted to carriage plates 7. An entry port 17 is located in the muffler near its rear portion 11. As shown in FIG. 4, the muffler is mounted on the drill carriage so that the opening in drill exhaust port 5 is aligned with the inlet port 17 of the muffler. An important feature of the present invention is that the cross-sectional areas of these ports are substantially equal to eliminate any adiabatic expansion at the muffler inlet. A gasket 18 between drill cylinder 4 and the muffler cover 8 at the ports acts to seal the connection between them.

Figure 2:
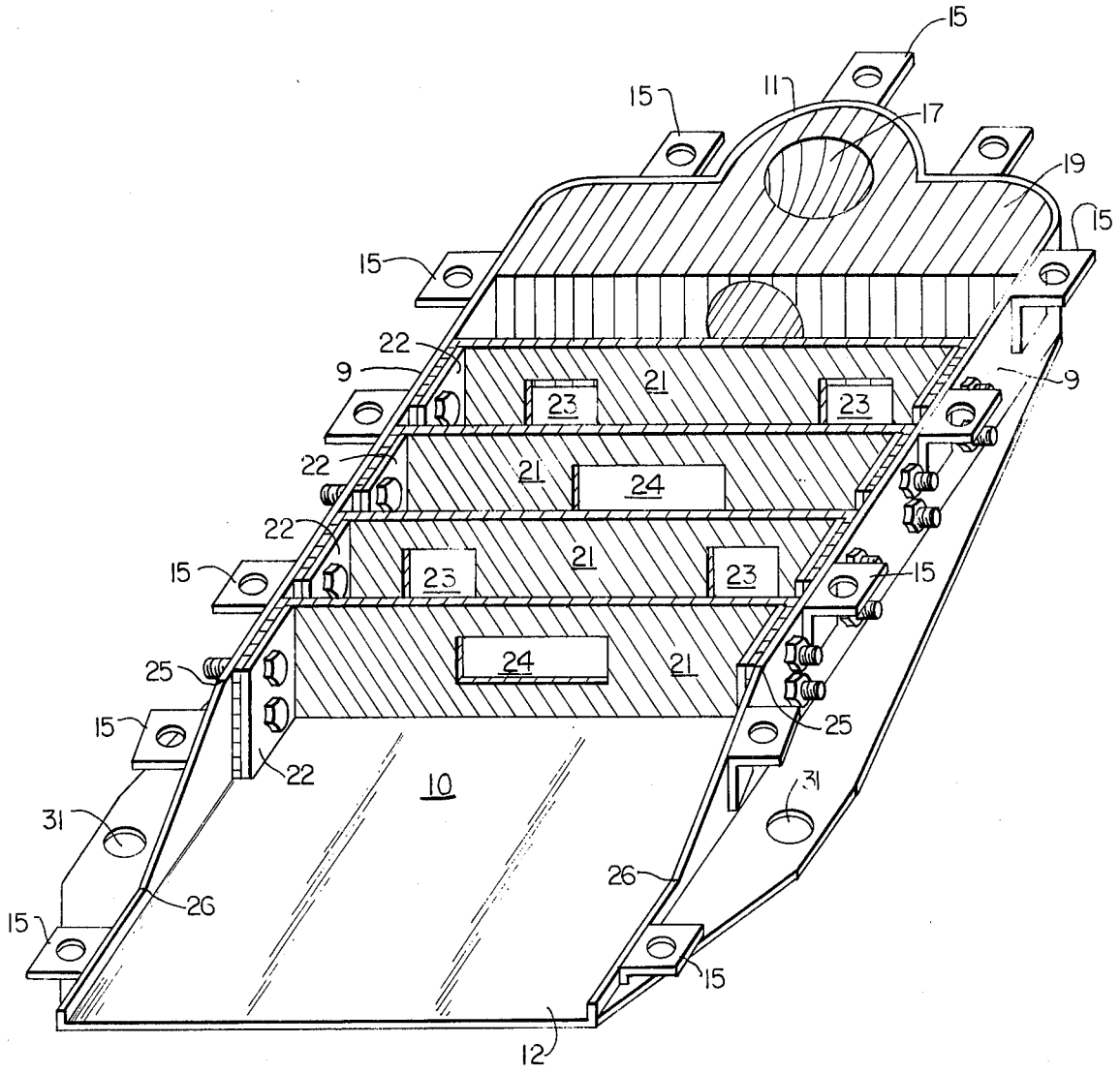
FIG. 2 is an isometric view of the muffler with the top removed.
Figure 4:
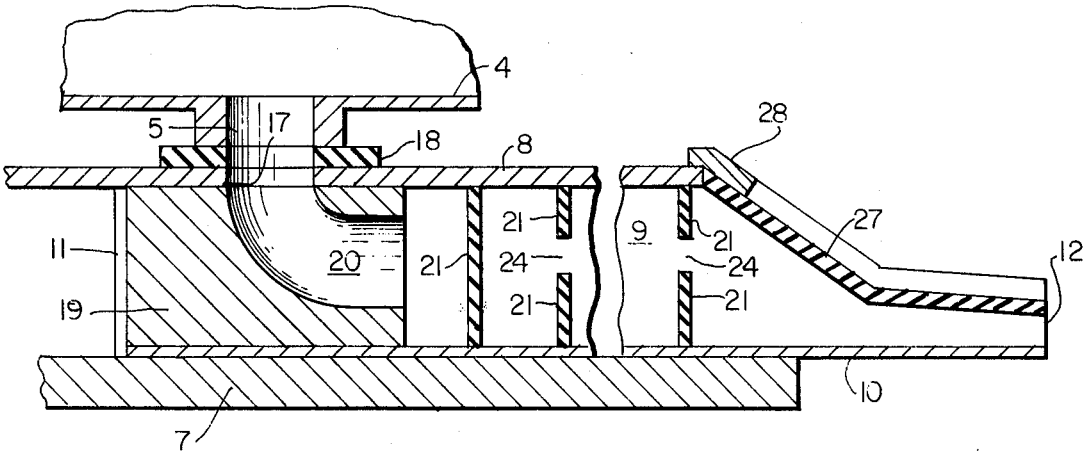
FIG. 4 is a sectional view along line A—A in FIG. 1.

In the interior of the muffler, as best shown in FIG. 2, the rear end portion is filled with plastic material, such as urethane rubber, or with metal (reference numeral 19) having entry passageway 20 therein. This is shown as being a right angled elbow in the FIG. 4. While this is generally the most desirable curve since it permits compact mounting of the muffler on the pneumatic drill carriage structure, this is not essential and the passageway may have other curvatures if desired, or even be straight. The essential requirement, as stated previously, is that there be no adiabatic expansion in the entry passageway.

Located within the body of the muffler casing are a plurality of flexible rectangular baffles 21, formed of a tough material such as neoprene rubber. As shown in FIG. 2 each is rigidly fastened to the muffler by means of metal fastening plates 22 which grip overlapping ends of the baffles when bolted to muffler sides 9. The baffles are arranged perpendicular to the flow of air through the muffler and have alternate edge and center holes 23 and 24 respectively. The area of the holes in each baffle are substantially equal to the cross-sectioned area of the entry port. In the embodiment shown the distance between the baffles is approximately equal to the height of the muffler but this may be varied if desired. It is apparent that the staggered arrangement of openings provide a sinusoidal path for the flow of air through the muffler. While shapes other than rectangular may be provide for the openings, the requirements of providing a sinusoidal path for the gas and the area of the openings being substantially equal to the entry port must be observed.

Figure 1:
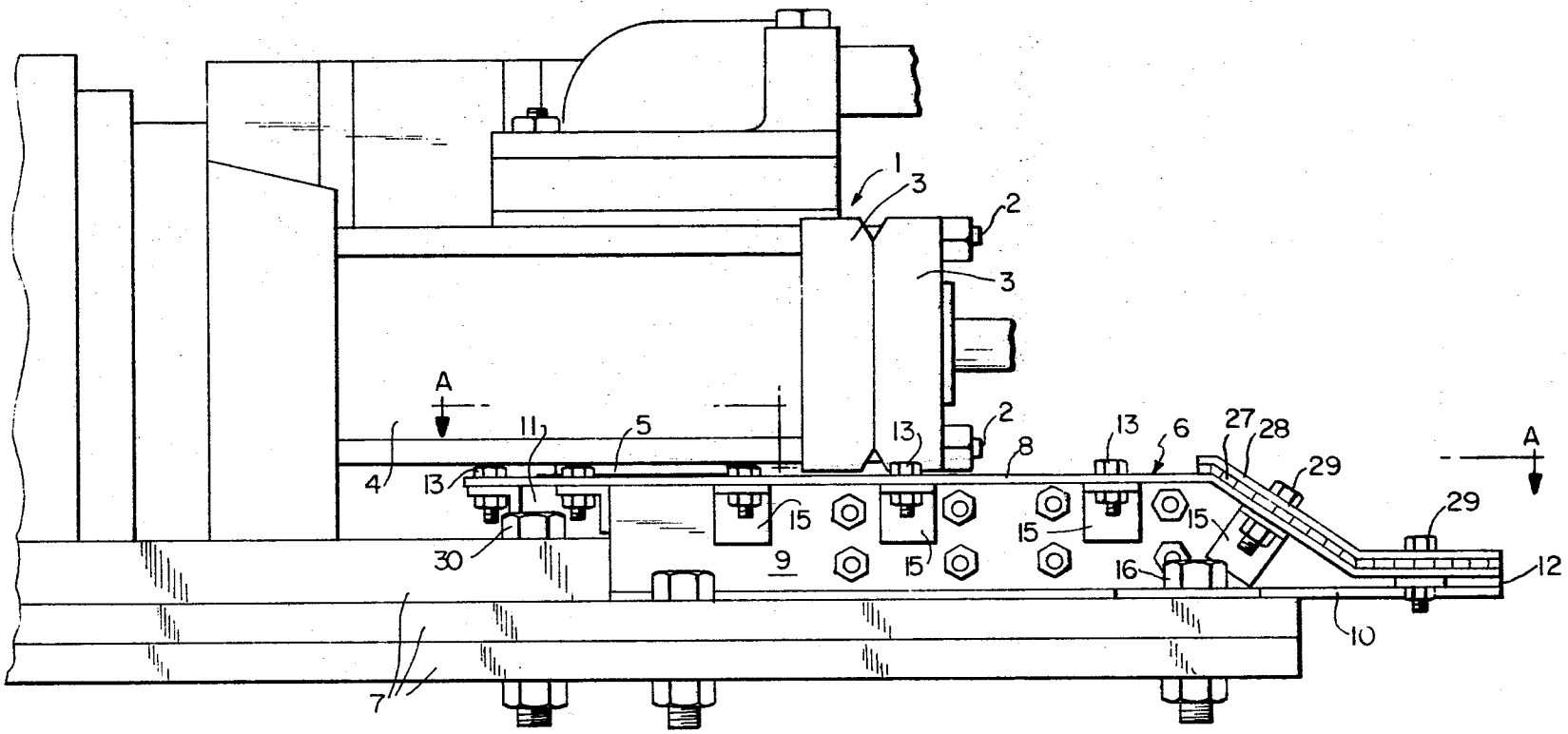
FIG. 1 is a side view showing the muffler in place attached to a pneumatic rock drill, only a portion of the drill being shown schematically.
Figure 3:
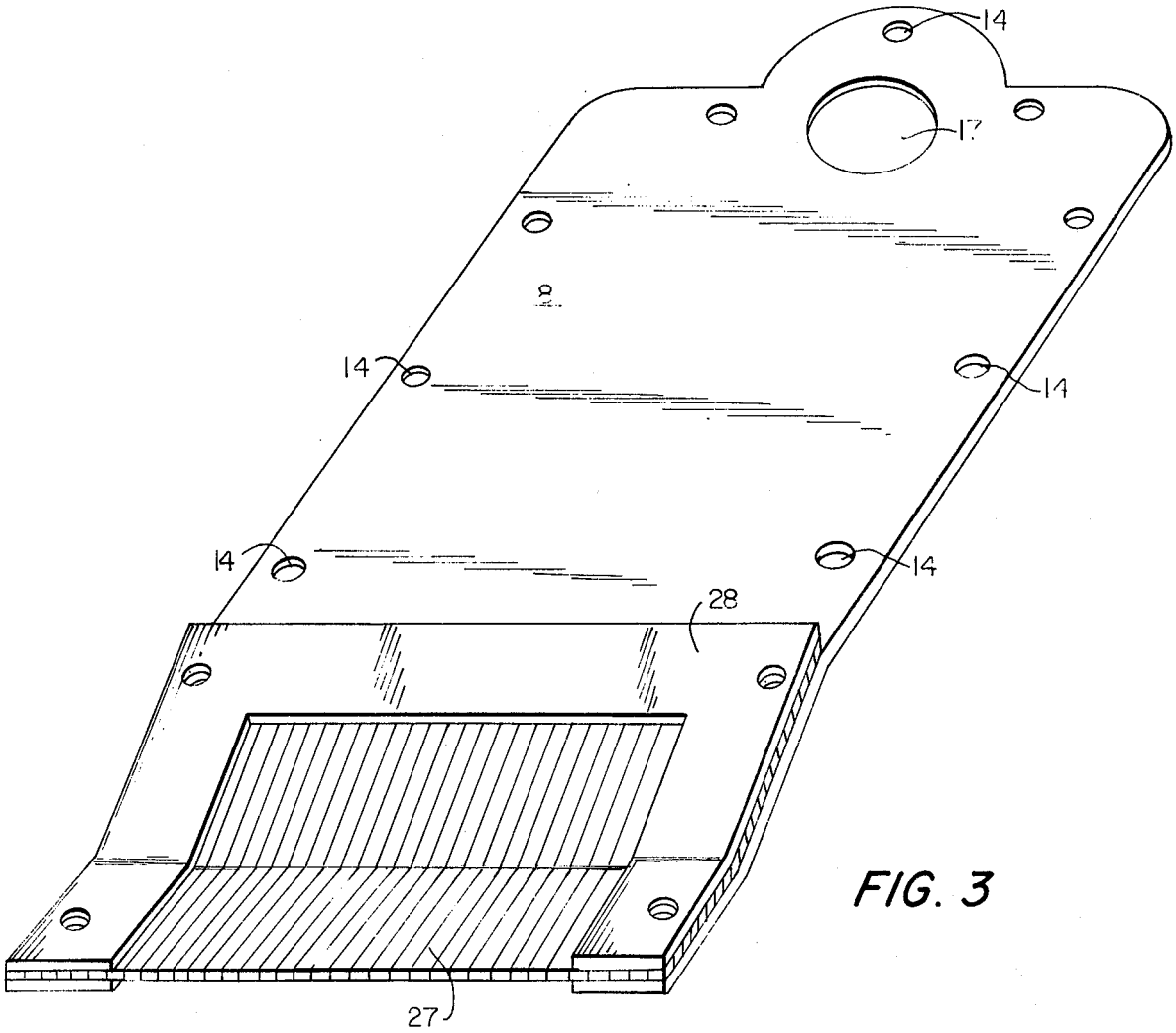
FIG. 3 is an isometric view of the muffler cover.

At a point past the last baffle, about one third from the end in the modification shown, the sides are tapered down starting at reference 25 to about one sixth their height and then continued, starting at 26, parallel to the end. The top cover, above the exit port 12 to the start of the downward taper consists of resilient sheet material 27, such as neoprene rubber, held firmly in place by being bolted at its outer edges to the edges of the upper plate by means of a U shaped cover plate 28 and bolts 29 (FIGS. 1 and 3)

The relative dimensions and spacing of the elements shown are not limited to the embodiment illustrated. The external dimensions can be varied for adaption to accomodate drills that vent exhaust air downwardly and through the top as well as through the side. Instead of bolting the muffler to the drill carriage, it may be attached by straps or other means. The number of baffles, the shape of the openings, their locations and structural material may be varied from that shown. Elastomers having sufficient oil and water resistance and strength may be employed instead of neoprene.

In operation, the restricted air flow through the entry passage 20, which prevents adiabatic expansion, directs the air at the center closed portion of the first baffle, setting it into vibratory motion. The air then passes through the edge openings 23 and flows through center opening 24 of the second baffle, and so forth, passing out through the central hole of the last baffle. All the baffles are set in strong vibratory motion, preventing the accumulation of ice on their surfaces. Since the baffles rub along the top and bottom inner surfaces of the muffler, ice accumulation thereon is prevented. After the last baffle, the gradual taper of the muffler height to the exhaust port height while maintaining the original muffler width avoids corners and sharp edges where ice can accumulate. The use of a flexible cover at the lower part of the tapered section and as one half of the exhaust slit provides an expandable final air outlet through which large pieces of ice may pass.

Typical noise levels measured in the laboratory at 90 psi air pressure are summarized in table 1. The free run entry refers to the drill running without the piston striking the striker-bar. The under load entry refers to the drill running under simulated drilling conditions, obtained by maintaining a constant opposing thrust on the striker-bar by an air piston coupled to it by a short length drill steel. The noise levels given are at a point 1.5 metres behind the exhaust port.

TABLE 1

Summary of jumbo drill noise levels at laboratory test stand, 90 psi air pressure

| Operating condition | Noise Level, dBA | | |
|---|---|---|---|
| | No muffler | Muffler No.1 | Muffler No.2 |
| Free run | 119 | 100 | 102 |
| Under load | 120 | 106 | 108 |

Typical noise levels measured in the mine for a two-drill jumbo are summarized in table 2. The tests were made in the same ore zone to keep penetration rates compatible, equal back heights were used to keep the acoustical environment the same, and the same driller operated the drills to keep operating techniques equal. In the free running operation the piston did not strike the striker-bar, thus the noise levels are due to air-exhaust. The remaining noise levels tabulated represent drilling noise, and include in addition to air-exhaust, drill steel and machine noise. The data shown that the combined drill steel and machine noise exceed the muffled air-exhaust noise by 5 to 6 dBA.

TABLE 2

Summary of jumbo drill noise levels measured in mine operator console, 95 psi air pressure

| Position of drilled hole | Noise Level, dBA | | | |
|---|---|---|---|---|
| | Without Mufflers | | With Mufflers | |
| | One drill | Two drills | One drill | Two drills |
| Free running | 113 | 116 | 98 | 101 |
| Lifter level | 114–115 | 116 | 104–105 | — |
| Knee level | 113–115 | 117 | 104–105 | 105–107 |
| Belt level | 112 | 115 | 104–105 | 106 |
| Console level | 115 | 115 | 104–105 | 107 |
| Eye level | 114–116 | 115 | 104–105 | 106 |
| Top | 112–114 | 115 | 104–105 | 107 |
| Start of hole | 116 | 118–119 | 104–105 | 107 |

We claim:

1. A muffler for the exit port of a pneumatically percussive tool comprising:

a casing having a quadrilaterial cross-sections along its longitudinal axis;

said casing having two ends, side walls and lateral walls joining said side walls, the side walls being shorter than the lateral walls;

an entry port at one end of the casing for receiving exhaust gases from said percussive tool;

said entry port having the same cross-sectional area as the exhaust port of the percussive tool;

a plurality of resilient baffles within said casing including an initial and a terminal baffle;

said baffles being spaced apart to form chambers within the casing;

opening within the baffles to provide a passage for exhaust gases from the percussive tool;

each opening in each baffle being staggered with respect to each opening in an adjacent baffle;

each baffle being rigidly attached to the side walls and contacting the lateral walls, whereby the baffles are capable of restrained vibratory motion while in sideable contact with the lateral walls;

said casing tapering down from a region beyond the terminal baffle toward the other end of the casing, whereby the side walls have a diminished height at the tapered position of the casing;

said other end of the casing being open to form an exit port;

one of the lateral walls adjacent the exit port consisting of a resilient sheet adapted to vibrate on impingement the exhaust gases passing through the muffler.

2. The muffler of claim 1 wherein the casing is of rectangular cross-section along its longitudinal axis.

3. The muffler of claim 2 wherein the casing at its entry port end comprises a filled-in solid portion having a curved passageway therein to serve as a conduit for the exhaust gases from the exit port of percussive tool to the muffler.

4. The muffler at claim 3 wherein the curved passageway is curved 90°.

5. The muffler of claim 4 wherein the exit port area is at least equal to the entry port area.

6. The muffler of claim 5 wherein the side walls taper down to a fraction of their height and then extend at said fractional height to the exit port.

* * * * *